US009232616B2

(12) United States Patent
Hiramatu et al.

(10) Patent No.: US 9,232,616 B2
(45) Date of Patent: Jan. 5, 2016

(54) LIGHTING APPARATUS

(71) Applicant: Panasonic Intellectual Property Management Co., Ltd., Osaka (JP)

(72) Inventors: Akinori Hiramatu, Nara (JP); Hiroshi Kido, Osaka (JP); Junichi Hasegawa, Osaka (JP); Shigeru Ido, Osaka (JP); Daisuke Ueda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/512,722

(22) Filed: Oct. 13, 2014

(65) Prior Publication Data

US 2015/0145433 A1 May 28, 2015

(30) Foreign Application Priority Data

Nov. 28, 2013 (JP) ..... 2013-246659

(51) Int. Cl.
*H05B 37/02* (2006.01)
*H05B 33/08* (2006.01)

(52) U.S. Cl.
CPC ..... *H05B 37/0272* (2013.01); *H05B 33/089* (2013.01); *H05B 33/0815* (2013.01); *H05B 33/0848* (2013.01)

(58) Field of Classification Search
CPC ..... H05B 37/0272; H05B 33/089; H05B 33/0815; H05B 33/0848
USPC ..... 315/291, 297, 307, 209 R
See application file for complete search history.

(56) References Cited

U.S. PATENT DOCUMENTS

| | | | | |
|---|---|---|---|---|
| 8,100,545 | B2 * | 1/2012 | Dupre et al. | 362/20 |
| 2013/0175937 | A1 | 7/2013 | Nakajo et al. | |
| 2013/0264961 | A1 * | 10/2013 | Chang et al. | 315/201 |
| 2014/0070699 | A1 * | 3/2014 | Genthon et al. | 315/82 |
| 2014/0117871 | A1 * | 5/2014 | Swatsky et al. | 315/246 |

FOREIGN PATENT DOCUMENTS

| | | | |
|---|---|---|---|
| JP | 2002-209344 | A | 7/2002 |
| JP | 2007-234415 | A | 9/2007 |
| JP | 2010-182499 | A | 8/2010 |
| JP | 2011-050163 | A | 3/2011 |
| JP | 2013-165630 | A | 8/2013 |

* cited by examiner

*Primary Examiner* — Don Le
(74) *Attorney, Agent, or Firm* — Renner, Otto, Boisselle & Sklar, LLP

(57) ABSTRACT

A lighting apparatus includes a light source module and a power supply module. The light source module includes an electrical light source and a transmitter circuit configured to transmit a wireless signal containing information about the light source. The power supply module is connected to the light source module and includes a power supply circuit configured to generate electric power for the light source, a receiver circuit configured to receive the wireless signal transmitted from the transmitter circuit, and a control circuit configured to control the power supply circuit in accordance with the wireless signal received through the receiver circuit.

5 Claims, 2 Drawing Sheets

LIGHTING APPARATUS

CROSS REFERENCE TO RELATED APPLICATIONS

The application is based upon and claims the benefit of priority of Japanese Patent Application No. 2013-246659, filed on Nov. 28, 2013, the entire contents of which are incorporated herein by reference.

TECHNICAL FIELD

The invention relates to a lighting apparatus (luminaire).

BACKGROUND ART

Conventionally, there is proposed a lighting apparatus including a light source module having a light source, and a power supply module that is connected to the light source module through wires and configured to generate electric power in order to power the light source (e.g., JP. Pub. No. 2007-234415).

It can be assumed that such a lighting apparatus is provided with a light source module configured to output a signal containing information about a light source thereof (a signal representing presence or absence of a malfunction, a rated current or the like), and a power supply module configured to receive the signal to operate in accordance with the information.

There is however a problem that wiring may be complicated if a signal line for transmitting the signal is provided between the light source module and the power supply module in addition to a power supply line for supplying electric power from the power supply module to the light source module.

SUMMARY

The present invention has been achieved in view of the above circumstances, and an object thereof is to provide a lighting apparatus capable of simplifying wiring.

In an aspect of the invention, a lighting apparatus includes a light source module and a power supply module. The light source module includes an electrical light source and a transmitter circuit. The transmitter circuit is configured to transmit a wireless signal containing information about the light source. The power supply module is connected to the light source module and includes a power supply circuit, a receiver circuit and a control circuit. The power supply circuit is configured to generate electric power for the light source. The receiver circuit is configured to receive the wireless signal transmitted from the transmitter circuit. The control circuit is configured to control the power supply circuit in accordance with the wireless signal received through the receiver circuit.

In the lighting apparatus, the wiring can be simplified in comparison with a case where the information about the light source is transmitted through wires.

BRIEF DESCRIPTION OF THE DRAWINGS

The figures depict one or more implementations in accordance with the present teaching, by way of example only, not bay way of limitations. In the figure, like reference numerals refer to the same or similar elements where.

DETAILED DESCRIPTION

Figure 1:
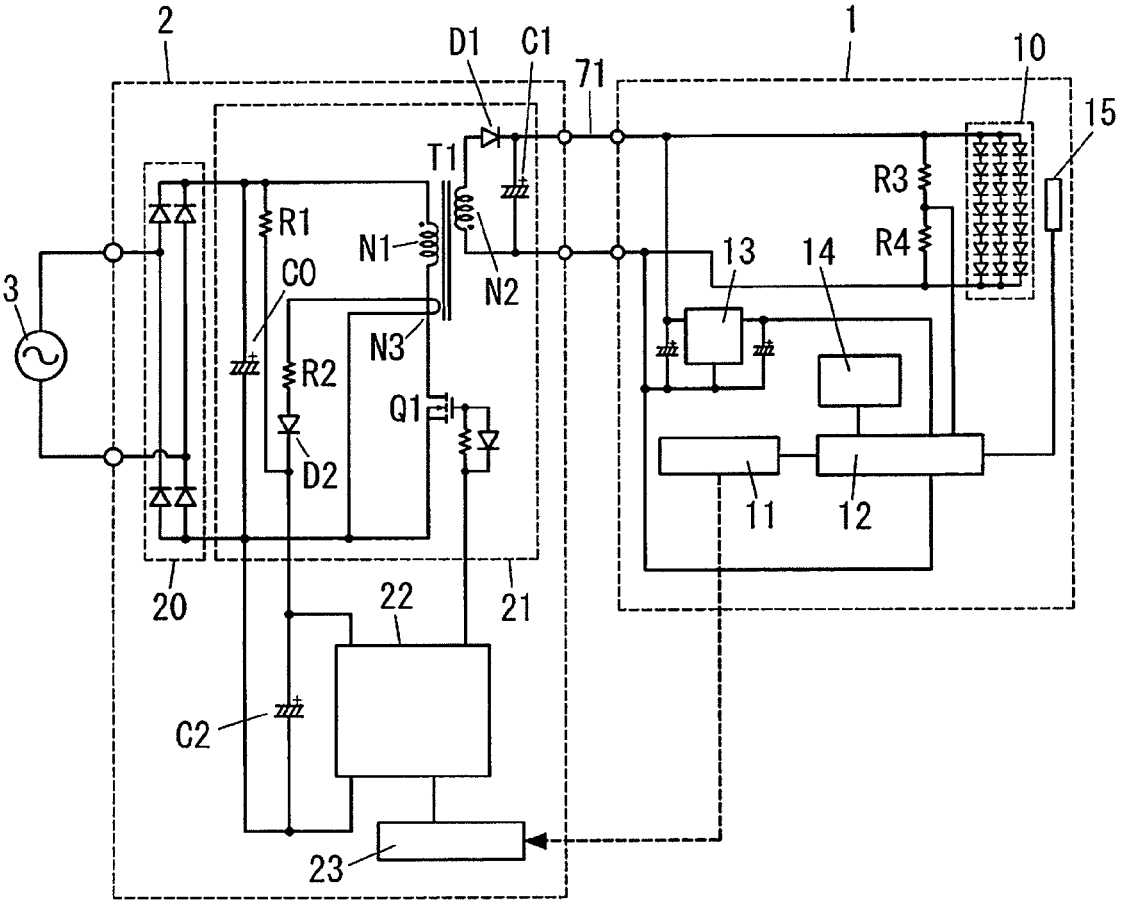
FIG. 1 is a circuit diagram of an embodiment of the present invention.

As shown in FIG. 1, a lighting apparatus in accordance with an aspect of the present invention includes a light source module 1 and a power supply module 2 electrically connected to the light source module 1. The light source module 1 includes an electrical light source 10 and a transmitter circuit 11 configured to transmit a wireless signal containing information about the light source 10. The power supply module 2 includes a power supply circuit 21 configured to generate electric power for the light source 10, a receiver circuit 23 configured to receive the wireless signal transmitted from the transmitter circuit 11, and a control circuit 22 configured to control the power supply circuit 21 in accordance with the wireless signal received through the receiver circuit 23.

In the lighting apparatus, the wireless signal may be a signal representing a characteristic of the light source 10.

In the lighting apparatus, the wireless signal may be a signal representing at least one of a malfunction of the light source 10, a temperature of the light source 10, and a cumulative lighting time of the light source 10.

Figure 2:
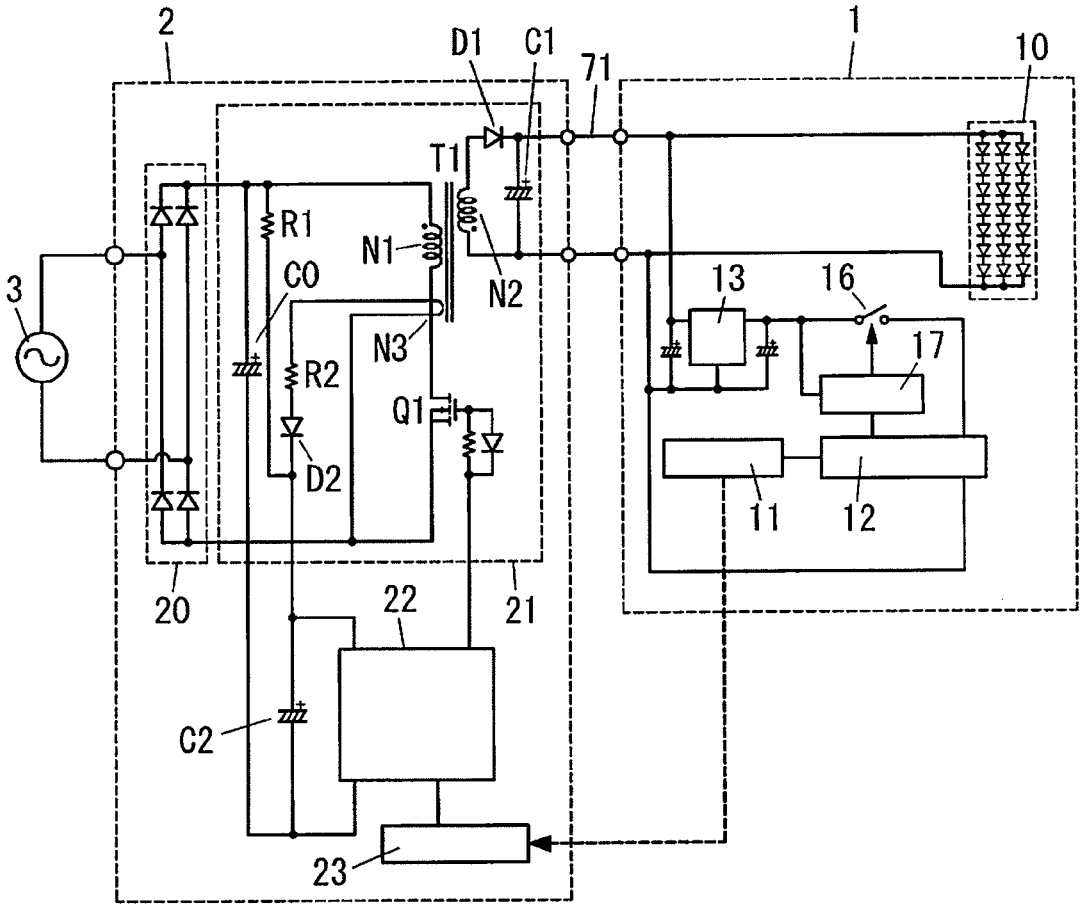
FIG. 2 is a circuit diagram showing a modified example of the embodiment.

In the lighting apparatus, as shown in FIG. 2, the light source module 1 may include a switch 16 configured to stop power supply to the transmitter circuit 11 after the wireless signal is transmitted.

In the lighting apparatus, the light source module 1 of the lighting apparatus is one of different light source modules of which rated outputs are different from each other. The transmitter circuit 11 is configured to transmit a wireless signal representing a rated output of the light source module 1 of the lighting apparatus. The control circuit 22 is configured to control the power supply circuit 21 so that it outputs electric power corresponding to a rated output of a minimum light source module of the different light source modules until the receiver circuit 23 receives the wireless signal. The minimum light source module is a light source module, having a minimum rated output, of the different light source modules. The control circuit 22 is configured to control the power supply circuit 21 so that it outputs electric power corresponding to the rated output represented by the wireless signal after the receiver circuit 23 receives the wireless signal. In another example, the control circuit 22 is configured to control the power supply circuit 21 so that it outputs electric power corresponding to a value in a range of which maximum value is set to the rated output represented by the wireless signal after the receiver circuit 23 receives the wireless signal. In this example, a minimum value of the range may be previously set.

Hereinafter, a best mode of the embodiment is explained with reference to figures.

As shown in FIG. 1, a lighting apparatus of the embodiment is provided with a light source module 1 including an electrical light source 10 and a power supply module 2 electrically connected to the light source module 1 through a power line 71 (two wires in the figure). Examples of the light source 10 include a light-emitting diode, a light-emitting diode array and a light source such as an organic electroluminescence device.

The power supply module 2 includes a diode bridge 20, a power supply circuit 21 and a control circuit 22. The diode bridge 20 is configured to full-wave rectify AC (alternating current) power from an external AC power supply 3. The power supply circuit 21 is configured to convert DC (direct current) input from the diode bridge 20 into prescribed DC output. For example, the DC input (signal) is converted into the DC output (signal) having a prescribed voltage or current. The control circuit 22 is configured to control the power supply circuit 21. A negative output terminal of the diode bridge 20 is electrically connected to ground.

For example, the power supply circuit 21 is formed of a flyback converter. The flyback converter includes a transformer T1, a switching device Q1, a diode D1 and a capacitor C1 (an output capacitor). The transformer T1 includes primary and secondary windings N1 and N2. A first end of the primary winding N1 is connected to a positive output terminal of the diode bridge 20. The switching device Q1 is connected between a second end of the primary winding N1 and a negative output terminal of the diode bridge 20. The power supply circuit 21 is further provided with a capacitor C0. The capacitor C0 is as across-the-line capacitor for noise reduction which is connected between the output terminals of the diode bridge 20 and connected in parallel with a series circuit of the primary winding N1 and the switching device Q1. A series circuit of the diode D1 and the capacitor C1 is connected between both ends of the secondary winding N2 of the transformer T1. The diode D1 is provided so as to allow an electric current to flow from the transformer T1 (the secondary winding N2) to a side of the capacitor C1 when power supply to the primary winding N1 is stopped (the switching device Q1 is turned off). A voltage across the capacitor C1 is an output voltage of the power supply circuit 21. That is, when the switching device Q1 is turned on, energy is stored in the transformer T1. When the switching device Q1 is turned off, the energy stored in the transformer T1 is released and supplied to a secondary side. As a result, the capacitor C1 is charged through the diode D1.

Operational examples of the control circuit 22 include a constant current control for adjusting an output current of the power supply circuit 21 to a prescribed target current and a constant voltage control for adjusting an output voltage of the power supply circuit 21 to a prescribed target voltage. For example, in a case of the constant current control, the control circuit 22 is configured to drive (turn on and off) the switching device Q1 while changing on-duty thereof at all times so that the output current of the power supply circuit 21 is kept at a level of the target current. This configuration of the control circuit 22 can be realized by a microcomputer (a processor) and accordingly detailed explanation and drawings are omitted. In a case of the constant voltage control, when the light source 10 includes a light-emitting diode(s), it is desirable that a resistor for current limiting (not shown) be connected in series to the light source 10.

The power supply module 2 is further provided with a series circuit of a resistor (a first resistor) R1 and a capacitor C2, which is connected between the output terminals of the diode bridge 20. The capacitor is a capacitor for control power supply that is a power supply for the control circuit 22. The transformer T1 is also provided with a tertiary winding N3. A first end of the tertiary winding N3 is electrically connected to ground, and a second end of the tertiary winding N3 is electrically connected to a junction of the resistor R1 and the capacitor C2 through a series circuit of a resistor (a second resistor) R2 and a diode D2. A cathode of the diode D2 is electrically connected to the junction of the resistor R1 and the capacitor C2, and an anode of the diode D2 is electrically connected to the resistor R2. That is, the capacitor C2 is to be charged by an output voltage of the diode bridge 20 and a voltage induced across the tertiary winding N3.

The light source module 1 includes a transmitter circuit 11 configured to transmit a wireless signal containing information about the light source 10, and a transmitter control circuit 12 configured to control the transmitter circuit 11. The power supply module 2 includes a receiver circuit 23 configured to receive the wireless signal transmitted from the transmitter circuit 11. The control circuit 22 is configured to control the power supply circuit 21 in accordance with the wireless signal received through the receiver circuit 23. Examples of the wireless signal include a radio signal and a light signal. In any case, the transmitter circuit 11 and the receiver circuit 23 can be realized by various techniques, and accordingly detailed explanation and drawings are omitted. The transmitter control circuit 12 can be realized by, e.g., a microcomputer (a processor) and accordingly detailed explanation and drawings are omitted.

The light source module 1 further includes a power supply circuit 13 as a transmitter power supply configured to generate a power supply for the transmitter circuit 11 and the transmitter control circuit 12 by appropriately stepping down a voltage from the power supply module 2. For example, the power supply circuit 13 can be formed of a three-terminal regulator. In an example, the light source module 1 of the lighting apparatus is one of different light source modules of which rated outputs are different from each other.

In a desirable embodiment, the transmitter control circuit 12 is configured to previously store information (request power information) about electric power (a rated output) for a rated lighting of the light source 10. Examples of the request power information include information about a rated voltage of the light source 10 and information about a rated current of the light source 10. The transmitter control circuit 12 is configured to control the transmitter circuit 11 so that it transmits a wireless signal (a request power signal) containing the request power information as a characteristic of the light source 10. In the power supply module 2, the control circuit 22 is configured to control the power supply circuit 21 so that it outputs electric power corresponding to a light source module 1 (a minimum light source module 1), having a minimum rated voltage or current, of predetermined different light source modules 1 until the receiver circuit 23 receives the request power signal. That is, the power supply circuit 21 is to output electric power corresponding to a minimum rated voltage or current of the minimum light source module 1. The control circuit 22 is also configured to control the power supply circuit 21 so that it outputs electric power corresponding to the request power information after the receiver circuit 23 receives the request power signal. For example, in a case where the request power information is information about a rated current of the light source 10 connected to the power supply module 2, the control circuit 22 may be configured to set the target current to the rated current of the minimum light source module 1 until the request power signal is received, and then to set a maximum value of the target current to a rated current represented by the request power signal after it is received.

In a desirable embodiment, the light source module 1 includes a clocking circuit 14 configured to measure a cumulative lighting time of the light source 10. The transmitter control circuit 12 is configured to control the transmitter circuit 11 so that it periodically transmits a wireless signal representing the cumulative lighting time measured through the clocking circuit 14. In the power supply module 2, the control circuit 22 is configured to allow the power supply circuit 21 to increase the output power thereof according to an increase in the cumulative lighting time so that an optical output of the light source 10 is kept constant by compensating a reduction in luminous flux in response to the increase in the cumulative lighting time. For example, the optical output (luminous flux at a glance) is kept at 70% of an optical output at a rated lighting of a new light source 10. The optical output may be varied by changing on-duty for intermittent lighting or varied by increasing or decreasing an output current (a target current) of the power supply circuit 21.

In a desirable embodiment, the light source module 1 includes a temperature detector 15 which is placed in proximity to the light source 10 and configured to detect (measure) a temperature of the light source 10. For example, the temperature detector 15 may be formed of a thermistor. The transmitter control circuit 12 is configured to control the transmitter circuit 11 so that it periodically transmits a wireless signal representing the temperature detected through the temperature detector 15. In the power supply module 2, the control circuit 22 is configured to decrease an output power of the power supply circuit 21 or deactivate the power supply circuit 21 in a case where the temperature represented by the wireless signal received through the receiver circuit 23 is higher than a prescribed temperature. In general, a forward voltage of a light-emitting diode more decreases as a temperature thereof becomes lower. The control circuit 22 may be therefore configured to more increase an output voltage (a target voltage) of the power supply circuit 21 as the temperature detected through the temperature detector 15 becomes lower in a case where the electrical light source 10 is formed of one or more light-emitting diodes and the control circuit 22 is configured to control the power supply circuit 21 in accordance with the constant voltage control.

In a desirable embodiment, the transmitter control circuit 12 is configured to determine whether or not a malfunction in the light source 10 occurs, based on a voltage across the light source 10 in a case where the control circuit 22 is configured to control the power supply circuit 21 in accordance with the constant current control. Examples of the malfunction include a short circuit and an open-circuit (no-load). The voltage across the light source 10 is detected with a voltage divider connected in parallel with the light source 10. In FIG. 1, the voltage divider is formed of a series circuit of resistors R3 and R4. The transmitter control circuit 12 is configured to determine that the open-circuit occurs if the voltage across the light source 10 is higher than a first threshold, and to then control the transmitter circuit 11 so that it transmits a wireless signal representing occurrence of the open-circuit. The transmitter control circuit 12 is also configured to determine that the short-circuit occurs if the voltage across the light source 10 is lower than a second threshold that is lower than the first threshold, and to then control the transmitter circuit 11 so that it transmits a wireless signal representing occurrence of the short-circuit. In the power supply module 2, the control circuit 22 is configured to decrease the output (an output voltage or current) of the power supply circuit 21 or deactivate the power supply circuit 21 when the receiver circuit 23 receives a wireless signal representing an open-circuit or a short-circuit.

In the aforementioned configurations, the wiring between the power supply module 2 and the light source module 1 can be simplified in comparison with a case where the information about the light source 10 is transmitted through wires.

In a desirable embodiment, the lighting apparatus is configured to stop power supply to the transmitter circuit 11 after a wireless signal is transmitted in a case where the wireless signal representing, e.g., a characteristic of the light source 10 is transmitted only just after the lighting apparatus is started (the power supply module 2 starts supplying electric power). In a concrete example of FIG. 2, the light source module 1 is provided with a switch 16 intervened between the power supply circuit 13 and both of the transmitter circuit 11 and the transmitter control circuit 12, and a switch driver circuit 17 configured to drive (turn on or off) the switch 16. The switch driver circuit 17 is configured to turn on the switch 16 in a first time period and to turn off the switch 16 in a second time period. The first time period is a time period until the transmission of the wireless signal is completed after the lighting apparatus is started. The second time period is a time period(s) other than the first time period, e.g., a time period until the lighting apparatus is deactivated after the transmission of the wireless signal is completed. For example, the switch 16 may be formed of a semiconductor switch. If the power supply to the transmitter circuit 11 and the transmitter control circuit 12 is stopped, power consumption can be suppressed in comparison with a case where electric power is always supplied to the transmitter circuit 11 and the transmitter control circuit 12.

Examples of the above-mentioned characteristic of the light source 10 represented by the wireless signal include a forward voltage of the light source 10, the number of light-emitting diodes constituting the light source 10, a color temperature of light from the light source 10, and the like.

Preferably, the light source module 1 is provided with an instruction input device (not shown) configured to receive an instruction for changing the characteristic of the light source 10 represented by the wireless signal. The transmitter control circuit 12 may be configured to change information to be contained in a wireless signal in accordance with the instruction received through the instruction input device.

In an embodiment, the power supply circuit 21 may be formed of a switching regulator such as a buck converter, and a combination circuit of a boost converter and a buck converter connected to a latter part of the boost converter.

Figure 3:
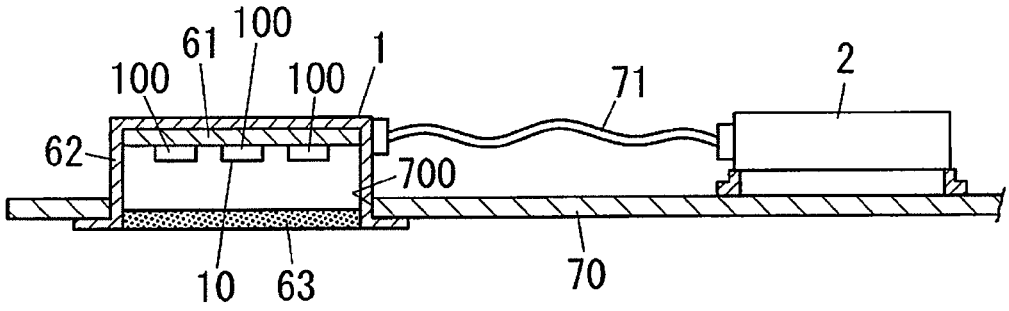
FIG. 3 shows a schematic configuration of the embodiment.

FIG. 3 illustrates a schematic configuration of the lighting apparatus. In an example of FIG. 3, a light source module 1 includes a printed wiring board 61 and light-emitting diodes 100 constituting a light source 10 mounted on a mount surface of the printed wiring board 61. The light source module 1 further includes a case 62 and a light-transmitting cover 63. The case 62 is shaped like a tube having a top base and a bottom opening. The printed wiring board 61 is fixed to an inner face of the top base with the mount surface side down. For example, the cover 63 is formed of material such as acrylic resin so as to have optically transparency. The cover 63 closes the bottom opening of the case 62. The case 62 is recessed in a through hole 700 cut in a ceiling member 70, and light of the light source 10 is to be emitted downward through the light-transmitting cover 63. The ceiling member 70 is a board member that is fixed with a space (a wiring space) provided between the board member and building parts such as concrete so that a thickness direction of the board member is parallel with a vertical direction. Bottom surfaces of the ceiling members 70 constitute a ceiling plane. The power supply module 2 is placed on a top surface of the ceiling member 70 beside the light source module 1 and electrically connected to the light source module 1 through a cable (the power line) 71. The necessary space above the ceiling members 70 can be reduced in comparison with a case where the power supply module 2 is placed on an upper side of the light source module 1. By providing a connector at an end or each end of the cable 71, the light source module 1 and the power supply module 2 can be easily connected to or disconnected from each other.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

The invention claimed is:

1. A lighting apparatus, comprising:

a light source module comprising an electrical light source and a transmitter circuit configured to transmit a wireless signal containing information about the light source; and a power supply module that is connected to the light source module and comprises a power supply circuit configured to generate electric power for the light source, a receiver circuit configured to receive the wireless signal transmitted from the transmitter circuit, and a control circuit configured to control the power supply circuit in accordance with the wireless signal received through the receiver circuit, wherein the wireless signal represents a characteristic of the light source, and the light source module comprises a switch configured to stop power supply to the transmitter circuit after the wireless signal is transmitted.

2. The lighting apparatus of claim 1, wherein the wireless signal represents at least one of a malfunction of the light source, a temperature of the light source, and a cumulative lighting time of the light source.

3. A lighting apparatus, comprising:

a light source module comprising an electrical light source and a transmitter circuit configured to transmit a wireless signal containing information about the light source; and a power supply module that is connected to the light source module and comprises a power supply circuit configured to generate electric power for the light source, a receiver circuit configured to receive the wireless signal transmitted from the transmitter circuit, and a control circuit configured to control the power supply circuit in accordance with the wireless signal received through the receiver circuit, wherein the light source module of the lighting apparatus is one of different light source modules of which rated outputs are different from each other, the transmitter circuit is configured to transmit a wireless signal representing a rated output of the light source module of the lighting apparatus, the control circuit is configured to control the power supply circuit so that the power supply circuit outputs electric power corresponding to a rated output of a minimum light source module of the different light source modules until the receiver circuit receives the wireless signal, the minimum light source module being a light source module, having a minimum rated output, of the different light source modules, and the control circuit is configured to control the power supply circuit so that after the receiver circuit receives the wireless signal, the power supply circuit outputs electric power:

corresponding to the rated output represented by the wireless signal; or corresponding to a value in a range of which maximum value is set to the rated output represented by the wireless signal.

4. The lighting apparatus of claim 3, wherein the wireless signal represents a characteristic of the light source.

5. The lighting apparatus of claim 3, wherein the wireless signal represents at least one of a malfunction of the light source, a temperature of the light source, and a cumulative lighting time of the light source.

* * * * *